US008141170B2

(12) United States Patent
Paterno

(10) Patent No.: US 8,141,170 B2
(45) Date of Patent: Mar. 27, 2012

(54) KNEE PROTECTION DEVICE AND METHOD

(76) Inventor: Michael J. Paterno, Monroe, NY (US)

( * ) Notice: Subject to any disclaimer, the term of this patent is extended or adjusted under 35 U.S.C. 154(b) by 313 days.

(21) Appl. No.: 12/501,413

(22) Filed: Jul. 11, 2009

(65) Prior Publication Data

US 2010/0281594 A1 Nov. 11, 2010

Related U.S. Application Data

(60) Provisional application No. 61/079,858, filed on Jul. 11, 2008, provisional application No. 61/163,017, filed on Mar. 24, 2009.

(51) Int. Cl.
*A41D 13/00* (2006.01)

(52) U.S. Cl. ..... 2/24; 602/26

(58) Field of Classification Search ..... 2/16, 22, 2/23, 24, 62, 455, 911; 128/878, 882; 602/23, 602/26, 62
See application file for complete search history.

(56) References Cited

U.S. PATENT DOCUMENTS 3,346,877 A 10/1967 Zirves
4,561,123 A 12/1985 Hull
4,685,153 A * 8/1987 Sims ..... 2/24
5,134,726 A * 8/1992 Ross ..... 2/465
5,309,570 A 5/1994 Grimm
5,524,292 A 6/1996 Hargens
5,556,374 A 9/1996 Grace et al.
5,628,063 A 5/1997 Reed
5,732,412 A 3/1998 Holden
5,987,643 A 11/1999 Beutler
6,176,816 B1 * 1/2001 Dicker et al. ..... 482/124
6,223,350 B1 5/2001 McFarlane
6,401,245 B1 6/2002 Slautterback
6,704,938 B2 3/2004 Crockett
7,122,016 B1 10/2006 DeToro et al.
7,181,770 B2 2/2007 Godshaw
7,194,770 B1 * 3/2007 Fecenko ..... 2/227
7,757,305 B2 * 7/2010 Toso ..... 2/79
7,841,018 B2 * 11/2010 Kotoske ..... 2/22

* cited by examiner

*Primary Examiner* — Tejash Patel
(74) *Attorney, Agent, or Firm* — Calhelha & Doyle LLC

(57) ABSTRACT

A knee protection apparatus has a knee protecting portion affixed atop one or more fixator struts which surround the side of a user's lower leg, and descend behind the leg near the Achilles tendon area of the wearer and continuing into the user's shoe where a heel cup grasps the user's foot at a posterior and plantar portion of the heel. The fixator strut or struts work to minimize or eliminate the vertical, horizontal and rotational movement of the knee pad away from its primary and intended area of protection at the patella.

19 Claims, 9 Drawing Sheets

KNEE PROTECTION DEVICE AND METHOD

CROSS-REFERENCE TO RELATED APPLICATION

This application claims the benefit of co-pending provisional application Ser. No. 61/079,858 filed Jul. 11, 2008, and co-pending provisional application Ser. No. 61/163,017 filed Mar. 24, 2009, which are both incorporated herein by reference.

FIELD OF THE INVENTION

The present invention relates to improvements in knee protection devices and methods of protecting knees.

BACKGROUND OF THE INVENTION

Knee pads are commonly worn by workers in a wide variety of trades and are typically adopted for safety, protection, comfort and convenience of the user.

Commonly comprised of at least padding for comfort, popular knee pad designs often have a rigid or semi-rigid outer shell for protection of the patella, as well as for durability of the appliance.

A significant drawback for currently available products is the tendency for a knee pad to undesirably move, or translate its position, during use or when the wearer moves between successive work locations. A knee pad is intended to protect the patella, but these unintended shifting movements, which may be described as translational movements of the device from its protective position, can cause discomfort, inconvenience and may facilitate injury. Such undesirable shifts may include movement in the body's frontal plane such as upward and downward along the long axis of the leg, movement in the body's transverse plane such as horizontal rotation about the leg and knee, and/or movement in the body's sagital plane such as lifting of the knee pad away from the patella.

The subject design minimizes each of the aforementioned problems. The knee protection apparatus described below allows for adjustability, stability and strength in a single device. Furthermore, use of the subject design can enhance the comfort, safety and efficiency of the user in a variety of work environments.

SUMMARY OF THE DISCLOSURE

The subject knee protection apparatus offers safety and comfort in an appliance configured to limit movement of a knee protection member away from its optimal location near the patella.

An embodiment of the knee protection apparatus has a patella cover which will typically be a padded and generally round or elliptical patella cover. A generally rigid or semi-rigid protective outer shell is secured to the outer surface of the patella cover, a strap is secured to one side of the structure encircling the back of a user's leg behind the knee and attached to the far side of the knee protecting member, the strap being typically adjustable, and at least one fixator strut is securely affixed to the knee protecting member, and thereafter descends from the knee protecting member and terminates at a cupped portion configured to engage the user's calcaneus heel region.

In a preferred embodiment, the fixator strut will descend from the knee protecting member, first anteriorly along one side of a user's leg, then laterally or medially and distally along the user's leg to the distal posterior area of the lower leg, the fixator strut terminating with a cupped portion configured to engage the user's calcaneus heel region for limiting superior and inferior movement of the knee protecting member in the frontal plane as well as limiting rotation of the knee protecting in the transverse plane.

In an embodiment of the subject device utilizing a pair of fixator struts, these may be symmetrically deployed on either side of a knee protecting member, each descending laterally or medially and distally along a user's leg, converging posteriorly near the distal posterior area of the lower leg, and terminating with a heel cup. In this embodiment, right and left leg versions of the device may be the same.

Generally, the fixator strut or struts may be permanently or adjustably affixed to the knee protecting member by any suitable means of securing the elements, such as with buckles, straps, welds, snaps, screws, rivets, pins, cotter pins or rings, or the like. The fixator struts may be offered in either fixed or variable lengths as desired. For typical users, user-adjustable devices may be preferred.

In embodiments where the knee protection apparatus comprises a single fixator strut, the single strut is configured to descend laterally or medially, then distally and posteriorly along the user's leg to the heel cup. In embodiments where a single fixator strut is used, a user may be provided with a pair of knee protection apparatuses in right and left leg versions that may be employed symmetrically. Alternatively, identical knee protection apparatuses may be used on both legs.

The fixator strut or struts will most typically be fabricated from rigid or semi-rigid molded thermoplastics such as nylon, polyethylene, polypropylene, and polyethylene terephthalates as well as many commercially available thermoplastic resins and copolymers. The fixator struts could be fabricated from metal, if desired.

The lower cupped portion of the fixator strut is configured to engage the user's calcaneus heel region and is of a dimension large enough to sufficiently make contact with the plantar surface of the user's heel and effectively limit superior and inferior movement of the knee protecting member in the transverse plane, but not so large as to cause discomfort to the user.

It will be recognized that use of the subject knee protection apparatus readily lends itself to a method for protecting the knees of a user. The method comprises the steps of affixing a generally round or elliptical padded patella cover to a generally rigid or semi-rigid protective outer shell secured to the outer surface of the padded knee cover; adjusting a strap secured to one side of the structure and encircling the back of the user's leg, behind the knee and attaching the strap to the far side of the knee protecting member; securely affixing at least one fixator strut to the knee protecting member which thereafter descends from the knee protecting member, first anteriorly along one side of a user's leg, then laterally or medially and distally along the user's leg to the distal posterior area of the lower leg, said fixator strut terminating with a cupped portion configured to engage the user's calcaneus heel region; wearing or covering a user's knee with the apparatus and affixing and securing the terminal end of the fixator strut to the user's calcaneus. The heel cup portion of the device serves to limit anterior and posterior movement of the knee protecting member within the sagital plane of the user and limit superior and inferior movement of the knee protecting member in the frontal plane while also limiting rotation of the knee protecting member in the transverse plane, all relative to a user of the apparatus. The method may comprise the further step of exposing the user to conditions requiring knee protection.

Other objects, features and advantages of the present invention will be apparent when the detailed descriptions of the preferred embodiments of the invention are considered with reference to the accompanying drawings, which should be construed in an illustrative and not limiting sense as follows:

DETAILED DESCRIPTION OF THE PREFERRED EMBODIMENTS

A preferred embodiment of the subject knee protection apparatus comprises: a knee protecting member having a patella cover and a protective outer shell complementary in configuration to the patella cover and securely affixed thereto; a strap secured to opposite sides of the knee protecting member and configured to encircle a user's knee to limit anterior and posterior movement of the knee protecting member within the sagital plane of the user; at least one fixator strut securely affixed to the knee protecting member, and thereafter descending from the knee protecting member, first anteriorly along a user's leg, then descending laterally or medially and distally along the user's leg to the distal posterior area of the lower leg, the fixator strut terminating with a cupped portion configured to engage the user's calcaneus heel region for limiting superior and inferior movement of the knee protecting member in the frontal plane as well as limiting rotation of the knee protecting member in the transverse plane.

Figure 1:
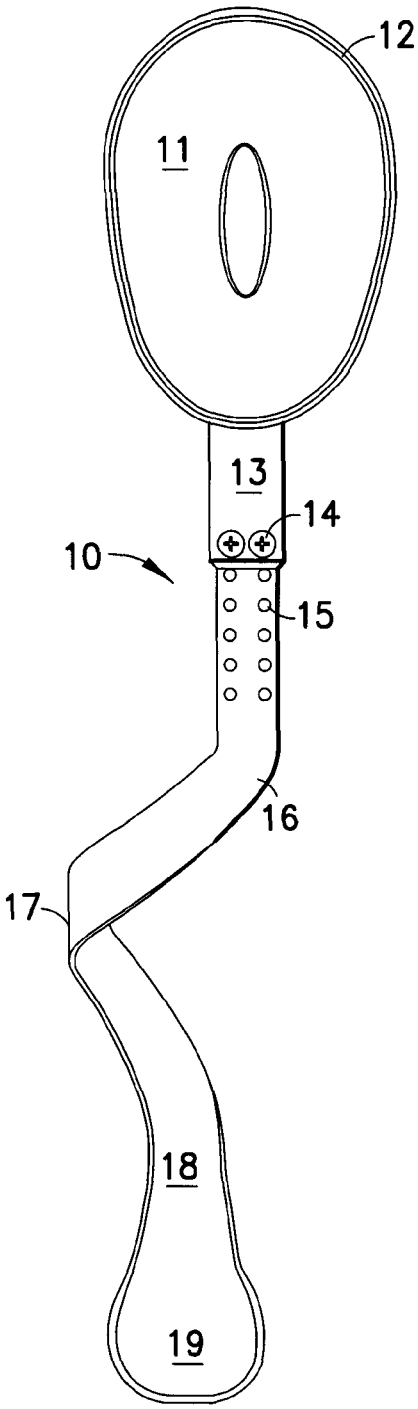
FIG. 1 is a front elevation view of an embodiment of the subject apparatus as designed to fit a user's right leg.

FIG. 1 is a front elevation view of a preferred embodiment of the subject apparatus 10 as designed to fit a user's right leg. The knee protecting member portion of the apparatus has a soft or cushioned patella cover 12 and a rigid or semi-rigid protective shell 11. At the bottom of the knee protecting member is a molded fixator strut receiver 13 into which the adjustable fixator strut 16 may be inserted. The fixator strut 16 may be permanently or semi-permanently affixed to the fixator strut receiver 13 by a variety of means of attachment such as screws, snaps, buckles, straps, welds, rivets, pins, cotter pins, cotter rings or the like. For example, as shown in FIG. 1, screws 14 are used to affix the fixator strut 16 to the fixator strut receiver 13. The fixator strut 16 is designed to descend from the knee protecting member and wrap around a user's leg. Beginning at the knee protecting member, the fixator strut descends anteriorly and distally, before wrapping laterally and distally to the posterior of the leg and terminating in a heel cup 19. In FIG. 1, fixator strut 16 has successive descending lateral portion 17 and posterior portion 18.

All descriptions in this specification which refer to a location on the apparatus, or placement of parts or bodily parts, are given with respect to a potential user of the subject knee protecting apparatus. It will be recognized that for most users, the knee protecting apparatus will comprise a complementary pair of such devices or appliances.

Figure 2:
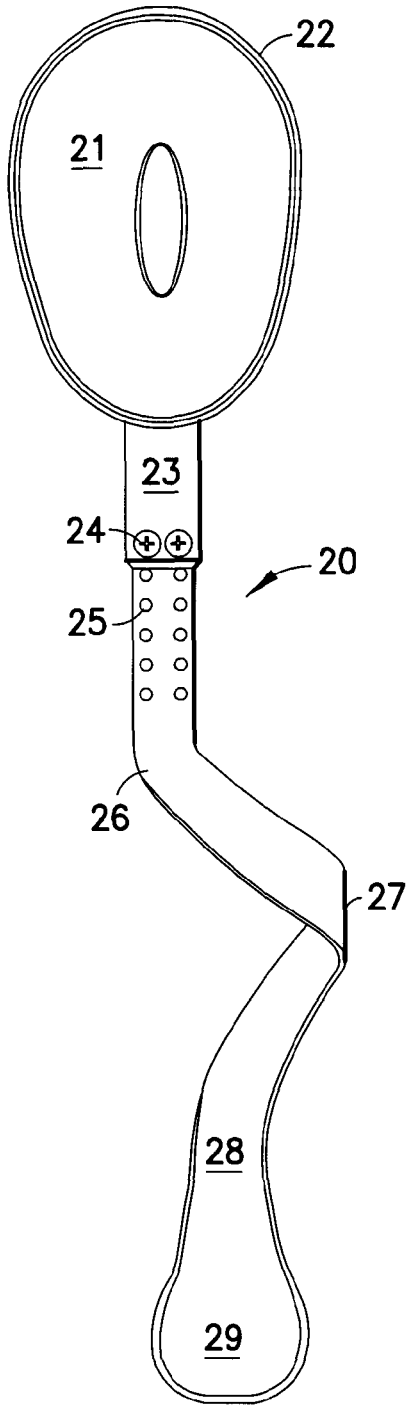
FIG. 2 is a front elevation view of an embodiment of the subject apparatus as designed to fit a user's left leg.

FIG. 2 is a representation of the knee protection apparatus 20 as designed for use on a user's left leg. This apparatus is symmetrical to the apparatus shown in FIG. 1, having the same features and properties as discussed above. The knee protecting member portion of the apparatus has a soft or cushioned patella cover 22 and a rigid or semi-rigid protective shell 21. At the bottom of the knee protecting member is a molded fixator strut receiver 23 into which the adjustable fixator strut 26 may be inserted. The fixator strut 26 may be permanently or semi-permanently affixed to the fixator strut receiver 23 by a variety of means of attachment such as screws, snaps, buckles, straps, welds, rivets, pins, cotter pins, cotter rings or the like. For example, as shown in FIG. 2, screws 24 are used to affix the fixator strut 26 to the fixator strut receiver 23. The fixator strut 26 is designed to descend from the knee protecting member and wrap around a user's leg. Beginning at the knee protecting member, the strut descends anteriorly and distally, before wrapping laterally and distally to the posterior of the leg and terminating in a heel cup 29. In FIG. 2, fixator strut 26 has successive descending lateral portion 27 and posterior portion 28.

Figure 3:
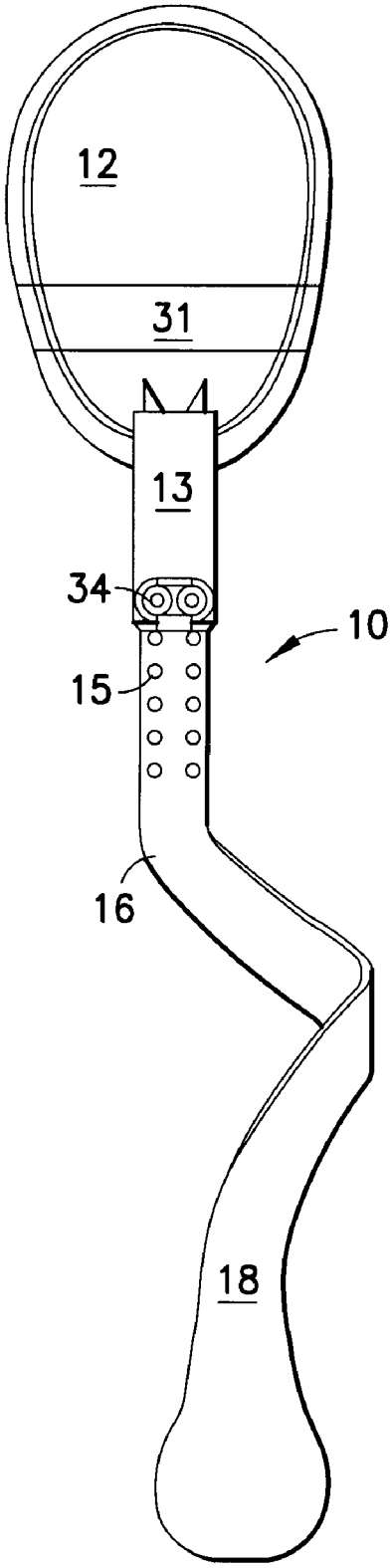
FIG. 3 is a rear elevation view of the apparatus of FIG. 1.
Figure 4:
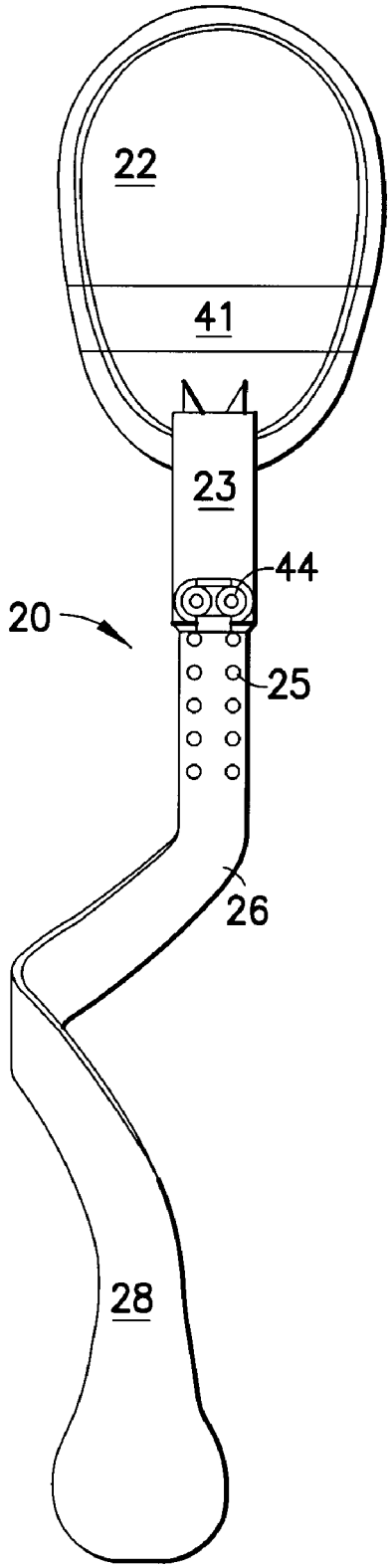
FIG. 4 is a rear elevation view of the apparatus of FIG. 2.

FIGS. 3 and 4 are rear views of the apparatuses shown in FIGS. 1 and 2, respectively. From this perspective, the soft or padded patella covers 12 and 22 of the knee protecting members can be seen. Also, one example of a means of securing the knee protecting member to the knee, here elastic web straps 31 and 41 may also be seen. In the depicted embodiments, the fixator struts 16 and 26 are inserted into the fixator strut receivers 13 and 23 and secured by attachment means 34 and 44. When previously described screws 14 and 24 are used, attachment means 34 and 44 will preferably be matching nuts. It will be recognized that a variety of straps and fasteners can be substituted for elastic straps 31 and 41. These may include adjustable plastic or leather straps with buckles, hook and loop fasteners and the like.

Figure 5:
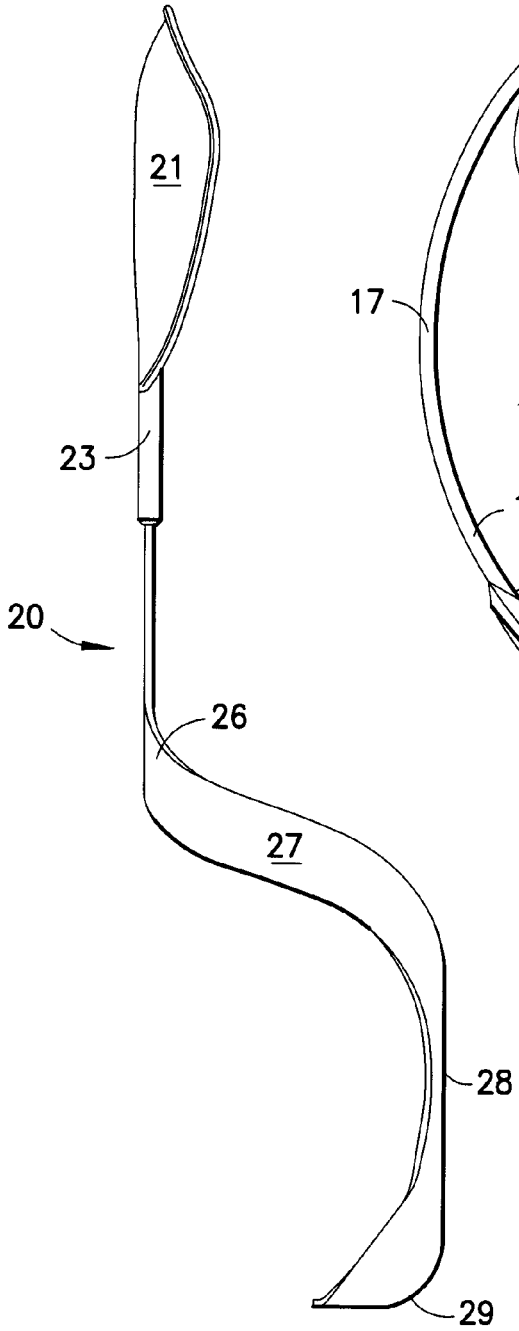
FIG. 5 is a side elevation view of the apparatus of FIG. 2.

FIG. 5 is a side elevation view of the subject apparatus 20 as shown in FIG. 2. This view depicts the shape of the fixator strut 26 as it descends from the knee protecting member 21 distally and anteriorly, then distally and laterally, then distally and posteriorly, and finally terminating in heel cup 29. In this view, lateral and posterior portions 27 and 28 of fixator strut 26 are shown. Generally, this configuration of the apparatus will be used on a user's left leg, however, as discussed below, it may be worn on either leg. In the preferred embodiment, a symmetrical apparatus would also be made for a user to wear on the opposite leg, as shown in FIG. 1.

Figure 6:
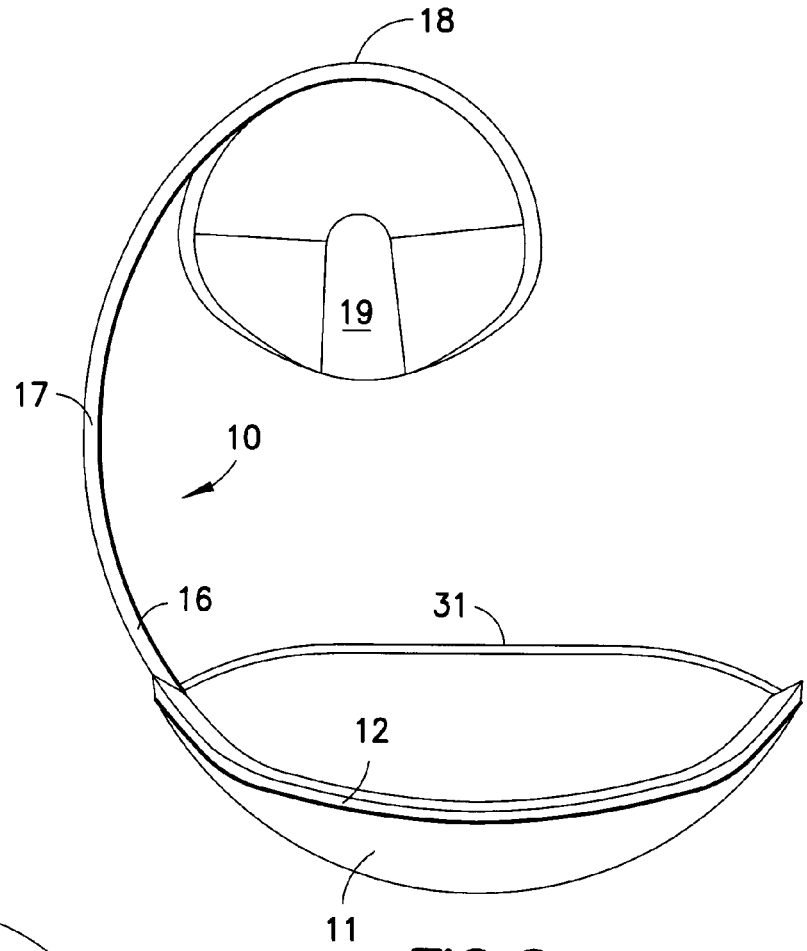
FIG. 6 is a top view of the apparatus of FIG. 1.

FIG. 6 is a top elevation view of the subject apparatus 10 of FIG. 1. This view also depicts how the apparatus is designed to wrap around the user's leg, beginning at the knee protecting member's protective shell 11 and patella cover 12, and wrapping laterally and distally around the user's leg before terminating in the heel cup 19. In this view, fixator strut 16 has lateral portion 17 and posterior portion 18. Generally, this configuration of the apparatus will be used on a user's right leg, however, as discussed below, it may be worn on either leg. In the preferred embodiment, a symmetrical apparatus would also be made for a user to wear on the opposite leg, as shown in FIG. 2.

Figure 7:
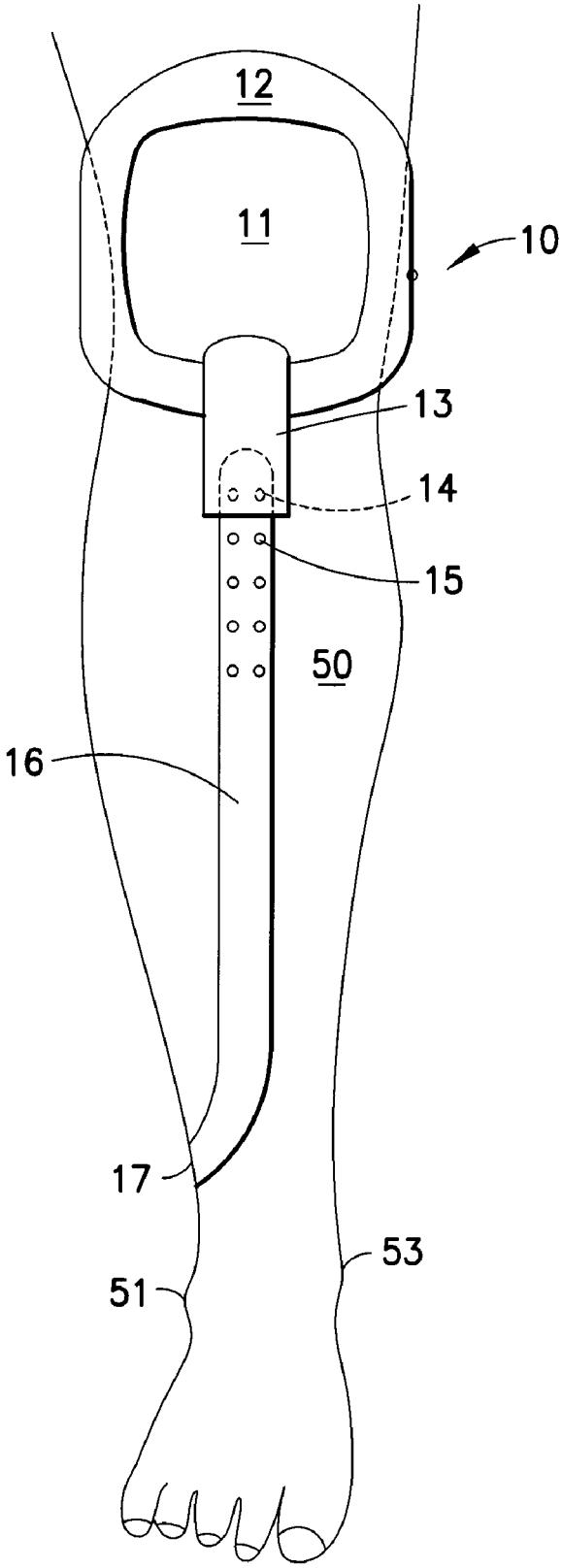
FIG. 7 is an embodiment of the subject apparatus as deployed by a user on the user's right leg.

FIG. 7 is a representation of the knee protection apparatus 10 of FIG. 1 as deployed by a user on the user's right leg 50. This figure shows a knee protecting member comprised of a soft or padded patella cover 12 which is covered by a rigid or semi-rigid protective shell 11. Fixator strut 16 having holes 15, is adjustably inserted into the fixator strut receiver 13, and may be permanently or semi-permanently attached by a variety of means of attachment such as screws, snaps, buckles, straps, welds, rivets, pins, cotter pins, cotter rings or the like. FIG. 7 also shows apparatus 10 as it wraps laterally at portion 17 around the user's leg above the lateral malleolus 51.

Figure 8:
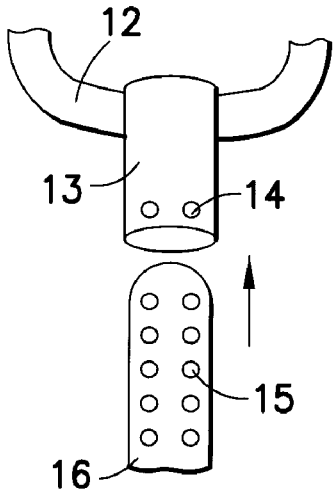
FIG. 8 is a detailed view of the adjustable portion of the apparatus of FIG. 7.

FIG. 8 is a detailed view of the adjustable portion of the apparatus 10 of FIGS. 1 and 7, where the fixator strut 16 is inserted into the fixator strut receiver 13. In a preferred embodiment, as shown here, there may be 5 pairs of holes 15 on the fixator strut 16, any one of which pairs may be matched with the pair of holes 14 on the fixator strut receiver 13. A single row of adjustment holes is possible, but less preferred. In the shown embodiment, any pin-like means of attachment may be used to permanently or semi-permanently secure the fixator strut 16 within the fixator strut receiver 13, such as screws, welds, rivets, pins, cotter pins, or the like. Other means of attachment may also be used, such as snaps, buckles, straps, cotter rings or the like. In this view, a portion of the padded patella cover 12 is also seen.

Figure 9:
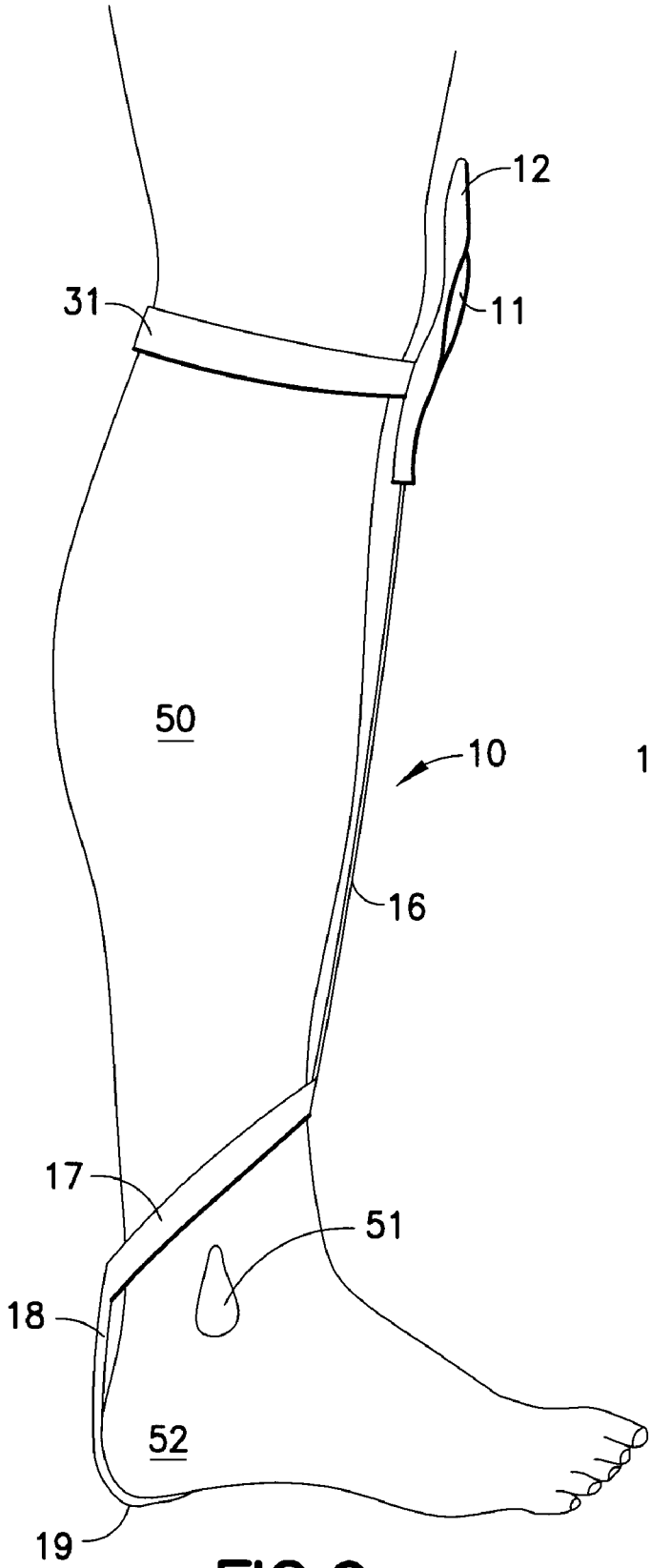
FIG. 9 is a side view of the apparatus of FIG. 7 as deployed by a user.

FIG. 9 is a side view of the apparatus 10 of FIG. 1 as deployed on a user's right leg 50. In this view, it can be seen that the fixator strut 16 descends from the knee protecting member protective shell 11 whereby lateral portion 17 wraps laterally and distally around the leg above the lateral malleolus 51 to the posterior of the leg at posterior portion 18 and terminates in a heel cup 19. The heel cup 19 fits under the heel 52, anchoring the knee protection apparatus 10 in place. Also seen in FIG. 9 is an example of a type of knee strap 31 that may be used to secure the top of the apparatus 10 to the user's leg 50. A variety of straps may be used as discussed above, to prevent movement of the device away from the optimal location near the patella.

Figure 10:
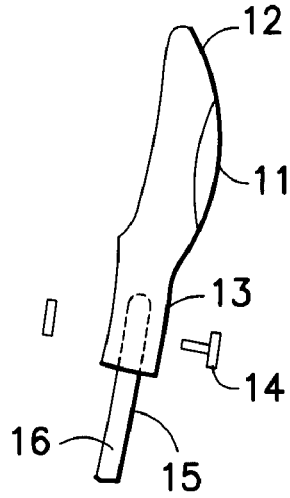
FIG. 10 is a detailed view of the adjustable portion of the apparatus of FIG. 9.

FIG. 10 is a detailed side view of the adjustable portion of the apparatus 10 of FIG. 1, where the fixator strut 16 is inserted into the fixator strut receiver 13. In the shown embodiment, a pin-like means of attachment 14 may be used to permanently or semi-permanently secure the fixator strut 16 within the fixator strut receiver 13, such as screws, welds, rivets, pins, cotter pins, or the like. Other means of attachment may also be used, such as snaps, buckles, straps, cotter rings or the like.

Figure 11:
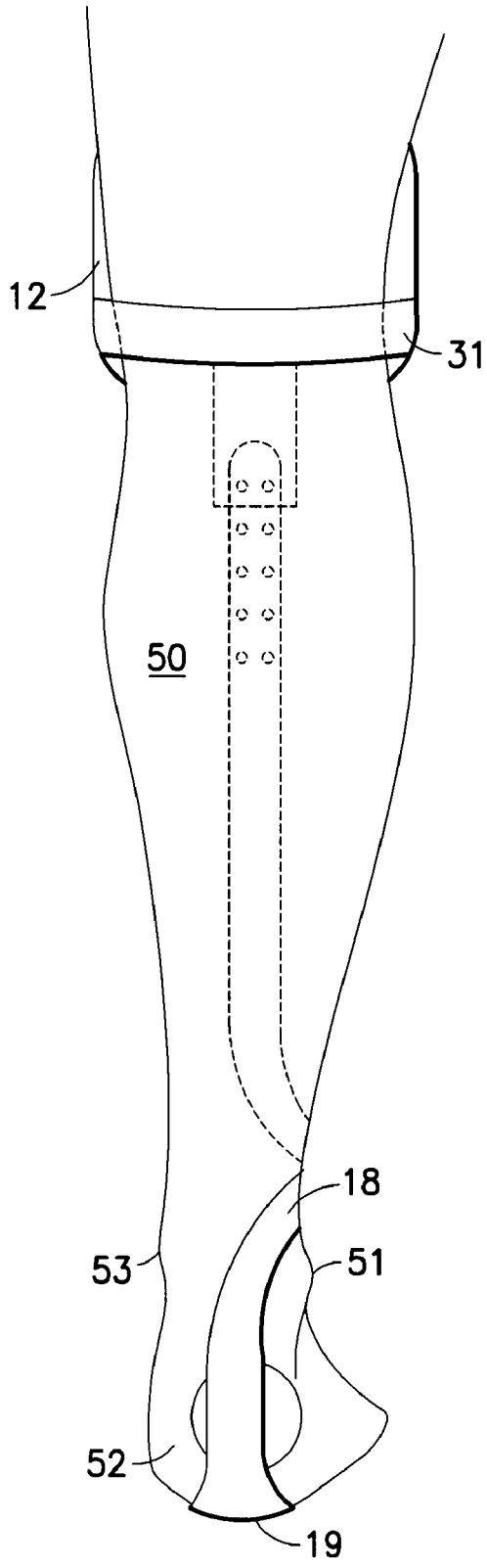
FIG. 11 is a rear view of the apparatus of FIG. 7 as deployed by a user.

FIG. 11 is a rear view of the apparatus 10 of FIG. 1 as deployed on a user's right leg 50. Seen in this view is the posterior portion 18 of the fixator strut 16 as it descends laterally from the anterior of the leg to the posterior of the leg and then terminates at the heel cup 19 below the heel 52. The dotted lines represent the anterior portion of the device in front of the user's leg.

Figure 12:
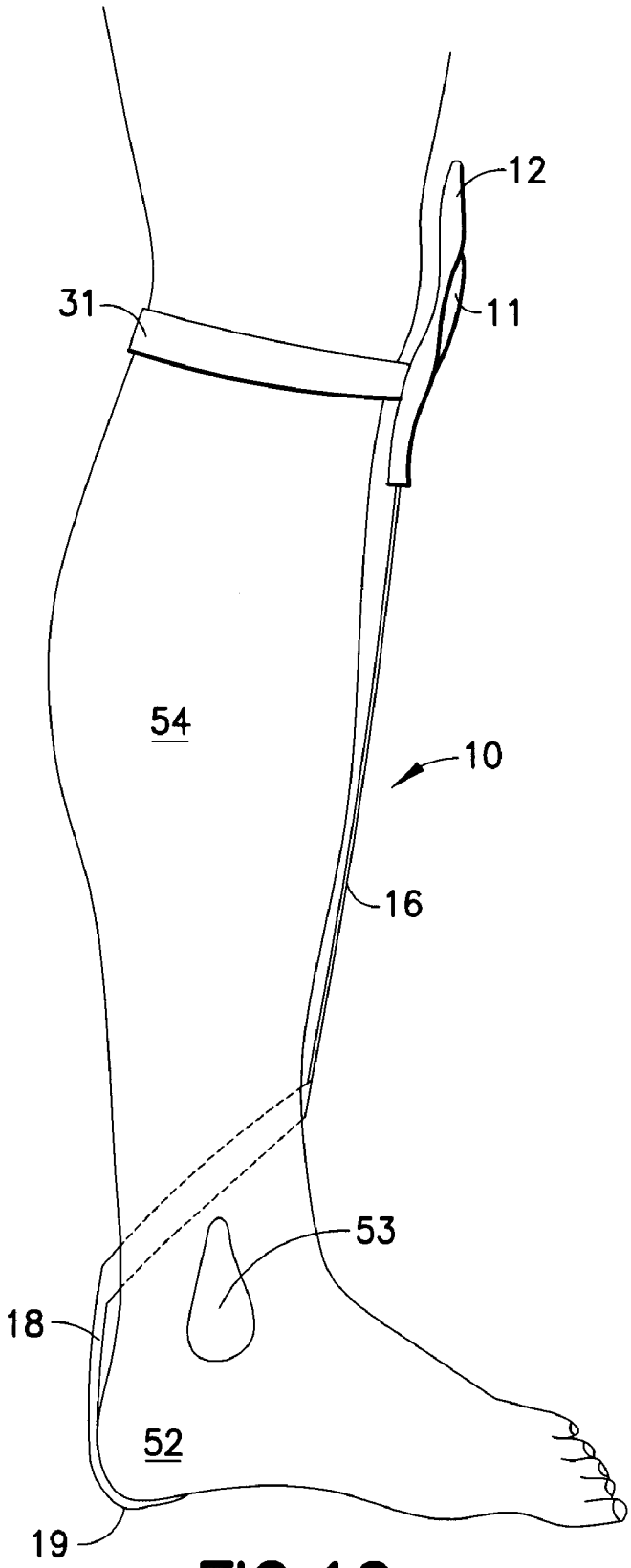
FIG. 12 is a side view of an embodiment of the subject apparatus as deployed by a user on the user's left leg.

FIG. 12 is a side view representation of the apparatus of FIG. 2 as deployed on the user's left leg 54. In this figure, the medial side of the user's leg 54 is seen, so the fixator strut 16 is represented by dotted lines as it descends around the lateral side of the leg, which cannot be seen, before reappearing at the posterior of the leg and terminating at the heel cup 19.

Figure 13:
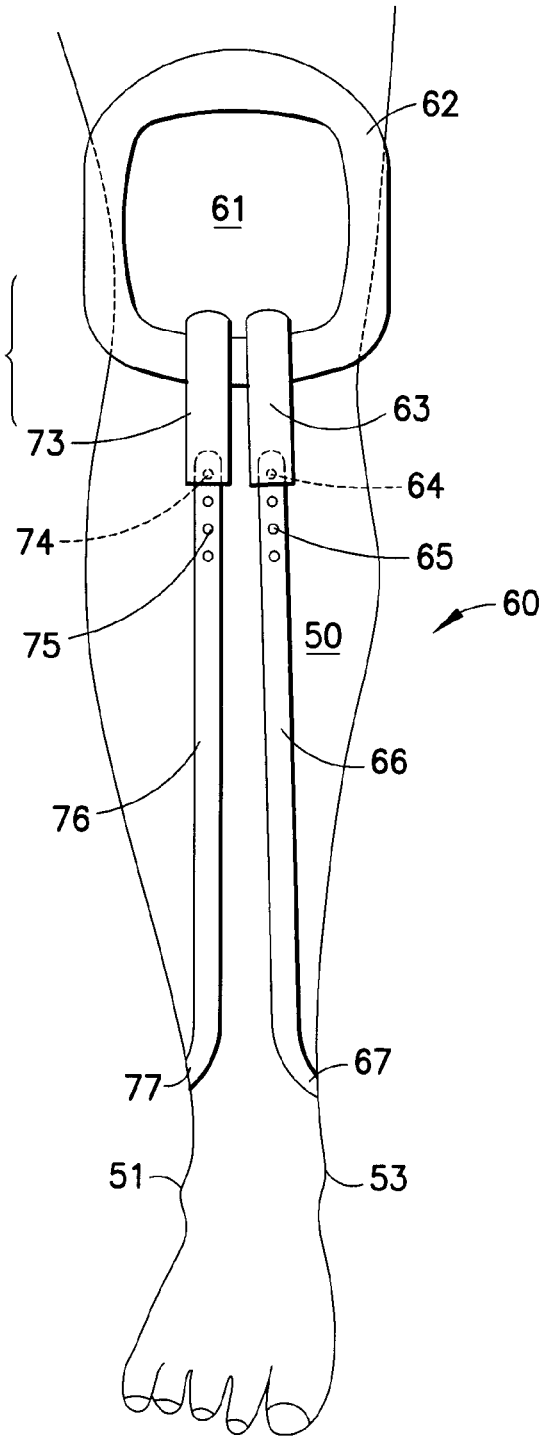
FIG. 13 is a representation of a further embodiment of the subject apparatus as deployed by a user on the user's right leg.

FIG. 13 depicts another embodiment of the subject apparatus 60 as deployed by a user on the user's right leg 50. In this embodiment, the protective knee covering comprises a soft or padded patella cover 62 affixed to a rigid or semi-rigid protective shell 61. The knee protecting member is secured in place by a pair of fixator struts 66 and 76 that are permanently or semi-permanently affixed to the knee protecting member and descend symmetrically down the anterior of the leg, then diverge laterally and medially around the leg to the posterior where the pair of fixator struts 66 and 76 converge near the distal posterior of the leg, and terminate in a heel cup, shown in FIG. 15. In this view, lateral and medial portions 77 and 67 of fixator struts 76 and 66 are depicted.

Figure 14:
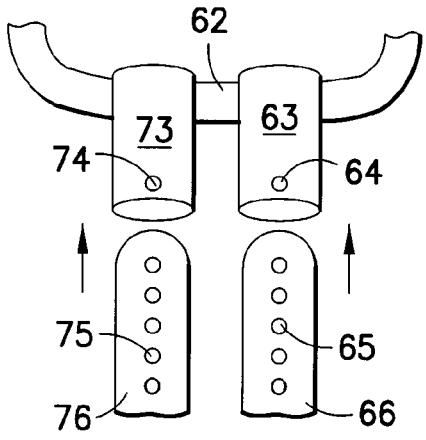
FIG. 14 is a detailed view of the adjustable portion of the apparatus of FIG. 13.

FIG. 14 is a detailed view of the adjustable portion of the apparatus 60 of FIG. 13. In the shown embodiment, the pair of fixator struts 66 and 76 have a series of 5 holes 65 and 75 which correspond to complementary holes 64 and 74 on the pair of fixator strut receivers 63 and 73. In this embodiment, any pin-like means of attachment may be used to permanently or semi-permanently secure the fixator struts 66 and 76 within the fixator strut receivers 63 and 73, such as screws, welds, rivets, pins, cotter pins, or the like. Other means of attachment may also be used, such as snaps, buckles, straps, cotter rings or the like.

Figure 15:
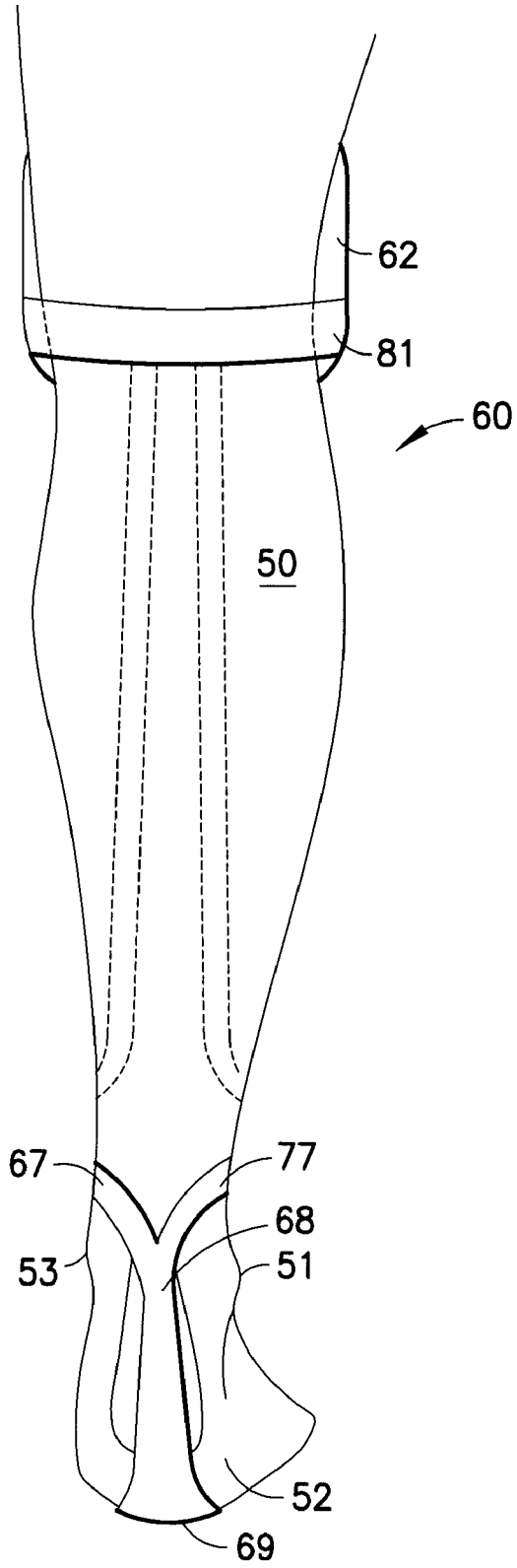
FIG. 15 is a rear view of the apparatus of FIG. 13 as deployed by a user on the user's right leg.

FIG. 15 is a representation of the rear of the apparatus 60 of FIG. 13 as deployed by a user on the user's right leg 50. In this figure, one example of a means of securing the knee protecting member to the knee, here an elastic web strap 81, may be seen. Further, this figure shows the convergence 68 of the pair of fixator struts 66 and 76 at the posterior of the leg, above the medial and lateral malleoli 51 and 53, and terminating in the heel cup 69, underneath the user's heel 52. The dotted lines represent the anterior portion of the fixator struts at the front of the user's leg and which are unseen in this view.

The subject disclosure is directed to an improved knee protection apparatus and method of protecting knees from injury and discomfort. As shown in the foregoing figures, an embodiment of the subject knee protection apparatus is comprised of a knee protecting member generally comprised of comfortable material such as a foam or cloth padded area and optionally but typically having a rigid or semi-rigid outer shell portion for protection rather than comfort. The rigid or semi-rigid protective shell will preferably be fabricated with molded or thermoformed thermoplastic resin, such as polyethylene. Other materials may be substituted for differing end uses of the protective appliance. It is contemplated that conventional materials will be chosen for strength and durability, rigidity and suitable flexibility for comfortable wear. Plastic resins may include polyethylene, PET and nylon thermoplastic polymers, among others. Other possible materials may be used, such as carbon-fiber or curable fiberglass composites, as well as metal. The fixator struts may be made of the same or different materials as desired which will also be selected for strength, durability and sufficient stability. Commercially available padding materials and attachment hardware may be utilized in the device. The part of the knee pad apparatus closest to the patella area of the knee generally has a concave shape for receiving the knee for comfort and protection. This area will typically be foam padding, usually covered with cloth or plastic film for durability so that the knee need not be in direct contact with the rigid outer shell of the device.

In use, the knee protecting member is situated in front of the user's knee when walking and under the user's knee when kneeling. The subject knee protection apparatus is configured to minimize or eliminate translational movements of the knee protecting member from its optimal location near the patella. Limitation of such undesirable translation movements is accomplished by securing the knee protecting member to one or more of the fixator struts which are secured to the knee protecting member and which then descend to the user's lower leg, and are secured to the user's heel.

In some embodiments of the subject knee protection apparatus, the apparatus may be furnished in configurations for use on either a right or a left leg, with a single fixator strut in each device. In this embodiment, a user will have a pair of symmetrical devices with fixator struts that wrap around each leg. However, since neither the heel cup nor the fixator strut is molded in such a way as to require the strut to wrap laterally, it will be recognized that a user could wear a pair of identical devices on either leg, in either a laterally or medially curved configuration. The use of identical struts may enable a more efficient and less expensive mode of manufacture as only one mold will be necessary. Further, a user may choose to wear a pair of symmetrical knee protection apparatuses, one on each leg, or substitute a pair of identical devices, again, one on each leg.

In both the right and left configuration of the single fixator strut embodiment of the subject knee protection apparatus, the fixator strut descends vertically from the knee protecting mmber anteriorly and distally along a user's lower leg before wrapping laterally around the user's leg to the posterior of the leg. The posterior portion of the fixator strut descends down the distal posterior of the leg. The apparatus terminates with a shallow heel cup portion which is sufficient to comfortably engage the user's calcaneus heel area within a shoe. Once the lower heel cup portion of the fixator strut is engaged with the user's heel, undesired movements and translations of the knee protecting member above are minimized or eliminated. The heel cup anchors the knee protection apparatus in place, thereby limiting vertical motion of the knee protecting member inferiorly and superiorly along a user's leg and rotational movements or translations of the knee protecting member in the transverse plane of the user. Since the majority of the unintended movements a knee protecting member might make are eliminated or limited by the fixator strut or struts, the knee protecting member only requires a light strap at the bend of the knee to prevent the knee protecting member from lifting away from the knee. This anchoring of the knee protecting member at the knee may be accomplished by any conventional method of securing a knee pad to a knee, including but not limited to an elastic web strap permanently or semi-permanently attached to one side edge of the knee protecting member and adjustably attached to the opposite side edge of the knee protecting member. As discussed above, a variety of straps and fasteners can be substituted for elastic straps, such as adjustable cloth, plastic or leather straps or webbing with buckles, hook and loop fasteners and the like. The strap width may be varied but will typically be about 1.5 inches thick. The knee protecting member does not require an additional strap at the top of the knee protecting member above the knee, however one may be added.

Although there may be variation in the location of the curve of the fixator strut, it will generally be towards the distal end of the leg away from the knee, but above the lateral and medial malleoli. In an embodiment having a single fixator strut, the strut will preferably descend distally from the knee protecting member down the user's leg, then curve and laterally wrap around to the posterior of the user's leg to what can be referred to as the Achilles portion of the strut which descends vertically along the distal posterior of the leg, and terminates in the heel cup, which will be contained within the user's shoe. In the case of a pair of symmetrical fixator struts, the fixator struts will preferably wrap symmetrically (laterally and medially) around the user's legs and converge at the distal posterior of the leg. The lower portion of the joined struts may be referred to as the Achilles portion of the device where the strut continues vertically downward and ultimately into the user's shoe.

There are a variety of means for securely attaching the fixator struts to the knee covering, any of which may be used. Generally, in a preferred embodiment, the knee protecting member will be manufactured to have a fixator strut receiver or a pair of fixator strut receivers, into which the fixator strut or a pair of fixator struts may be inserted and securely fastened. The fixator strut receiver may be affixed to the knee protecting member by welds, rivets, buckles, screws, or any other suitable means of permanent attachment. Alternatively, the fixator strut receiver and the rigid or semi-rigid protective shell portion of the knee protecting member may be molded as a single unit from a suitable thermoplastic resin such as those discussed above. The fixator strut or struts may be permanently or semi-permanently and securely fastened within the fixator strut receiver by a variety of means of attachment as discussed above.

The fixator strut allows adjustability for wearers of different heights. This can be accomplished by a variety of methods, via interlocking parts on the fixator strut and fixator strut receivers, or via removable rivets, snaps, screws, or any other means of fasteners, usually at ½ inch increments. The lower portion of the fixator strut receiver may have a single pair of horizontal linear holes, which will overlap several sets of equally spaced linear holes on the fixator strut when the fixator strut is inserted into the fixator strut receiver. The fixator strut approximates the inside of the fixator strut receiver so that the holes of the fixator strut receiver will directly overlap the holes in the fixator strut to achieve different heights. Though the converse embodiment could occur with the fixator strut having a single set of holes for adjustment and the fixator strut receiver having multiple sets of ascending holes to account for the height differential, a preferred method is for the fixator strut to have multiple holes, interlocking sections, and screws, snaps, or other means of fastener, as this maximizes the stability of the apparatus. The height setting for the apparatus to achieve proper fit for the user can be accomplished via several different methods. A preferred method used for this apparatus is achieved by determining the difference between the plantar aspect of the calcaneus and the point of contact of the same knee touching the ground for the wearer in the kneeling position. This is noted to occur anatomically approximately between and sometimes including the superior aspect of the tibial tubercle and apex of the patella, while in the kneeling position. For people of heights between 5 ft 5 in and 6 ft 5 in, the length of the span between the calcaneus and the patella is generally between approximately 18.5 in and 23 in. The series of holes along the fixator strut allows the length of the strut to be adjusted to account for the height differential in ½ inch increments.

The method of protecting knees of a person is accomplished by securing a comfortable and protective knee protecting member to the knee area of the leg and securing it with one or more relatively inflexible fixator struts. When used in pairs, the fixator struts generally descend symmetrically anteriorly from the lower portion of the knee protecting member, then wrap laterally or medially and distally to the posterior of the user's leg. The fixator struts thereafter converge below the calf muscle at the distal posterior of the leg and continue to a terminal heel cup for securing the end of the knee protection apparatus within the shoe of the user, thereby minimizing unintended vertical movements of the knee protecting member inferior and superior to the user's knee and simultaneously minimizing unintended horizontal movements of the knee protecting member to either side of the user's knee.

When used in the single strut embodiment, the fixator strut generally descends anteriorly from the lower portion of the knee protecting member, then wraps laterally and distally to the posterior of the user's leg. The fixator strut then continues to a terminal heel cup for securing the end of the knee protection apparatus within the shoe of the user, thereby minimizing unintended vertical movements of the knee protecting member inferior and superior to the user's knee and simultaneously minimizing unintended horizontal movements of the knee protecting member to either side of the knee. The method also includes maintaining the knee protecting member in proximity to the front of the patella by means of a strap encircling the users leg and affixed to opposite sides of the knee protecting member.

It will be recognized that the fixator strut or struts greatly reduce the potential for rotation of the knee protecting member about the knee itself, facilitating both comfort and protection. Furthermore, the design eliminates translation of the knee protecting member on the user's body during use. The fixator strut or struts bend away from the top of the Achilles tendon, thereby accommodating different calf sizes. The rigid protective shell of the knee protecting member typically has a uniform convex shape. It would be possible to flatten the convex shape to reduce the amount of rotation around the body caused by a fully convex surface, thus offering additional stability.

In the above-described embodiments, the knee protecting member portion of the knee protection apparatus extends below and above the knee. It will be recognized that weight is not borne on the area above the knee cap; rather the weight when kneeling is approximately near the middle of the knee cap. Thus in some embodiments it will be possible to eliminate the part of the knee protecting member above the knee cap.

The foregoing knee protection apparatus is designed to fit comfortably inside a shoe or boot, and to accommodate conventional clothing pant legs. The heel cup need not cover a substantial portion of the foot or heel area, only enough to grasp the heel bone, generally a length of about 2 in and a width of about 2.75 in is sufficient. Such design permits plantarflexion and dorsiflexion of the foot and thus does not limit the normal motion of the foot during walking, while providing an adequate anchor for the fixator strut. When the user's heel is set in the heel cup, the heel cup portion of the fixator strut is secured in place, thereby limiting translation of the heel cup without pinching or callusing. It is sufficient to just cover the heel bone, in the calcaneus area and need not interfere with the user's shoe.

The invention now being fully described, it will be apparent to one of ordinary skill in the art that many changes and modifications can be made thereto without departing from the spirit or scope of the invention as set forth herein.

The invention claimed is:

1. A knee protection apparatus comprising:

a. a knee protecting member having (i) a patella-cover and (ii) a protective outer shell complementary in configuration to the patella-cover and securely affixed thereto;

b. a strap secured to opposite sides of the knee protecting member and configured to encircle a user's knee to limit anterior and posterior movement of the knee protecting member within the sagital plane of the user;

c. a rigid or semi-rigid fixator strut securely affixed to the knee protecting member, and thereafter descending from the knee pad, first anteriorly along a user's leg, then descending laterally or medially and distally along the user's leg to the distal posterior area of the lower leg, and d. the fixator strut terminating with a cupped portion configured to engage the user's calcaneus heel region for limiting superior and inferior movement of the knee protecting member in the frontal plane as well as limiting rotation of the knee protecting member in the transverse plane.

2. The apparatus of claim 1 wherein the at least one fixator strut is permanently affixed to the knee protecting member.

3. The apparatus of claim 1 wherein the at least one fixator strut is adjustably affixed to the knee protecting member.

4. The apparatus of claim 3 wherein the at least one fixator strut is adjustably affixed to the knee pad by means of buckles, straps, snaps, screws, rivets, clevis pins, cotter pins or cotter rings.

5. The apparatus of claim 1 wherein the knee protecting member has a generally round and convex configuration.

6. The apparatus of claim 1 wherein the protective outer shell is a generally rigid or semi-rigid protective shell.

7. The apparatus of claim 1 wherein the strap is adjustable.

8. The apparatus of claim 1 wherein the at least one fixator strut is a pair of fixator struts, symmetrically deployed on opposite sides of the knee protecting member, each strut symmetrically descending laterally or medially and then distally with reference to a user's leg, thereafter converging posteriorly near the distal posterior area of the lower leg, and terminating with a heel cup.

9. The apparatus of claim 1 wherein the at least one fixator strut is a single fixator strut deployed to descend laterally or medially, distally and posteriorly along the user's leg and terminating with a heel cup.

10. The apparatus of claim 9 wherein the fixator strut is used asymmetrically when paired with a second apparatus.

11. The apparatus of claim 9 wherein the fixator strut is used symmetrically when paired with a second apparatus.

12. The apparatus of claim 1 wherein the patella-cover is a padded patella-cover.

13. The apparatus of claim 1 wherein the fixator strut comprises a molded thermoplastic resin.

14. The apparatus of claim 1 wherein the protective shell is molded thermoplastic resin.

15. The apparatus of claim 1 wherein the terminal cupped portion for engaging the calcaneus heel region is configured to make contact with the plantar surface of the user's heel and thereby limit superior and inferior movement of the knee protecting member in the transverse plane.

16. The apparatus of claim 15 wherein the terminal cupped portion is configured to minimize discomfort to a user.

17. A method for knee protection comprising the steps of:

affixing a knee protecting member having a patella-cover secured to a generally rigid protective outer shell secured to the outer surface of the padded patella cover and a strap secured to opposite sides of the knee protecting member and configured to encircle the back of user's leg behind the knee, and configured to limit anterior and posterior movement of the knee protection member within the sagital plane of a user; a rigid or semi-rigid fixator strut securely affixed to the knee protecting member, and thereafter descending from the knee protection member, first anteriorly along one side of user's leg, then laterally or medially and distally along user's leg to the distal posterior area of the lower leg, the fixator strut terminating with a cupped portion configured to engage the user's calcaneus heel region for limiting superior and inferior movement of the knee protecting member in the frontal plane as well as limiting rotation of the knee protecting member in the transverse plane;

wearing or covering a user's knee with the apparatus and affixing the fixator strut to the user's calcaneus; and exposing the wearer to conditions requiring knee protection.

18. The apparatus of claim 1 further comprising a second rigid or semi-rigid fixator strut mounted to the knee protecting member and descending therefrom symmetrically opposite the first fixator strut and terminating with the distal cupped portion configured to engage the user's calcaneus heel region.

19. The method of claim 17 wherein the knee protecting member is configured with a second rigid or semi-rigid fixator strut mounted thereto and descending therefrom symmetrically opposite the first fixator strut and terminating with the distal cupped portion configured to engage the user's calcaneus heel region.

* * * * *